US008898990B2

(12) United States Patent
Drew

(10) Patent No.: US 8,898,990 B2
(45) **Date of Patent: *Dec. 2, 2014**

(54) MODULAR BUILDING BLOCKS WITH INTERLOCKING REINFORCEMENT RODS

(71) Applicant: Coobs Canada Ltd., Richmond (CA)

(72) Inventor: James Joseph Drew, Richmond (CA)

(73) Assignee: Coobs Canada Ltd., Richmond (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/203,557

(22) Filed: Mar. 10, 2014

(65) Prior Publication Data

US 2014/0202111 A1 Jul. 24, 2014

Related U.S. Application Data

(63) Continuation-in-part of application No. 13/481,708, filed on May 25, 2012, now Pat. No. 8,667,760.

(60) Provisional application No. 61/491,130, filed on May 27, 2011.

(51) Int. Cl.

| | |
|---|---|
| ***E04C 2/04*** | (2006.01) |
| ***E04B 2/08*** | (2006.01) |
| ***E04C 1/00*** | (2006.01) |
| ***E04C 5/16*** | (2006.01) |
| ***E04B 1/41*** | (2006.01) |
| ***E04B 2/16*** | (2006.01) |
| *E04B 2/02* | (2006.01) |

(52) U.S. Cl.

CPC ... *E04B 2/08* (2013.01); *E04C 1/00* (2013.01); *E04C 5/162* (2013.01); *E04B 1/40* (2013.01); *E04B 2/16* (2013.01); *E04B 2002/0215* (2013.01); *E04B 2002/0254* (2013.01)

USPC ..... 52/600

(58) Field of Classification Search

USPC ..... 52/600, 602, 603, 604, 605, 606, 607

See application file for complete search history.

(56) References Cited

U.S. PATENT DOCUMENTS

| | | | | |
|---|---|---|---|---|
| 1,385,606 | A | 7/1921 | Christensen | |
| 2,141,397 | A * | 12/1938 | Locke | 52/204.2 |
| 2,703,487 | A * | 3/1955 | Ossoinack | 52/592.3 |
| 2,745,276 | A * | 5/1956 | Kuhlman | 52/100 |
| 2,786,301 | A * | 3/1957 | Torricelli | 446/115 |
| 2,929,236 | A | 3/1960 | Steward et al. | |
| 3,295,286 | A * | 1/1967 | Schaich | 52/583.1 |
| 3,382,632 | A | 5/1968 | Grofcsik | |
| 3,782,061 | A | 1/1974 | Minutoli et al. | |
| 4,031,678 | A * | 6/1977 | Schuring | 52/570 |
| 4,320,606 | A * | 3/1982 | GangaRao | 52/125.5 |

(Continued)

*Primary Examiner* — Mark Wendell
*Assistant Examiner* — Keith Minter
(74) *Attorney, Agent, or Firm* — Cameron IP

(57) ABSTRACT

A modular building block assembly comprises a modular building block having a first load-bearing surface with a key. There is a recess in the key. The recess has a shoulder disposed therein and side walls extending from the shoulder to a mouth thereof. A reinforcement rod extends into the recess and a coupling for connecting vertically aligned reinforcement rods is disposed in the recess. The vertically aligned reinforcement rods each threadedly engage the coupling. A locking plate engages the coupling to prevent the coupling from rotating relative to the locking plate. The locking plate sits within the recess and rotation of the locking plate within the recess is prevented by the side walls of the recess.

17 Claims, 12 Drawing Sheets

(56) References Cited

U.S. PATENT DOCUMENTS

| | | | | |
|---|---|---|---|---|
| 4,726,567 | A * | 2/1988 | Greenberg | 256/19 |
| 5,355,647 | A | 10/1994 | Johnson et al. | |
| 5,365,714 | A * | 11/1994 | Potvin | 52/590.2 |
| 5,678,373 | A * | 10/1997 | Franklin et al. | 52/439 |
| 5,899,040 | A * | 5/1999 | Cerrato | 52/604 |
| 6,098,357 | A * | 8/2000 | Franklin et al. | 52/223.7 |
| 6,105,330 | A * | 8/2000 | Nanayakkara | 52/606 |
| 6,244,009 | B1 * | 6/2001 | Cerrato | 52/604 |
| 6,564,524 | B1 * | 5/2003 | Gruita | 52/604 |
| 6,758,020 | B2 | 7/2004 | Cerrato | |
| 6,871,453 | B2 | 3/2005 | Locke | |
| 6,931,797 | B2 | 8/2005 | Drew | |
| 6,957,518 | B1 | 10/2005 | Koch, Jr. | |
| 7,117,647 | B2 * | 10/2006 | Clarke | 52/233 |
| 7,546,712 | B2 * | 6/2009 | Shaw | 52/223.8 |
| 7,584,584 | B2 * | 9/2009 | Fennell, Jr. | 52/607 |
| 8,061,095 | B2 | 11/2011 | Bucheger | |
| 8,122,668 | B2 * | 2/2012 | Fang | 52/568 |
| 8,136,329 | B2 * | 3/2012 | Willis | 52/848 |
| 8,201,370 | B1 * | 6/2012 | Goodwin | 52/285.2 |
| 8,225,578 | B2 * | 7/2012 | Azizi Ronagh | 52/747.1 |
| 8,281,528 | B2 * | 10/2012 | Clarke | 52/223.7 |
| 8,601,759 | B2 * | 12/2013 | Bucheger | 52/223.7 |
| 8,667,760 | B2 | 3/2014 | Drew | |
| 2004/0020145 | A1 * | 2/2004 | Matsufuji | 52/223.7 |
| 2005/0252118 | A1 * | 11/2005 | Matsufuji | 52/223.7 |
| 2006/0248825 | A1 * | 11/2006 | Garringer | 52/233 |
| 2006/0288656 | A1 * | 12/2006 | Clarke | 52/233 |
| 2007/0056235 | A1 * | 3/2007 | Kohler | 52/223.7 |
| 2007/0079566 | A1 * | 4/2007 | Neill et al. | 52/284 |
| 2009/0090069 | A1 | 4/2009 | Willis | |

* cited by examiner

MODULAR BUILDING BLOCKS WITH INTERLOCKING REINFORCEMENT RODS

CROSS-REFERENCE TO RELATED APPLICATION

This application is a continuation-in-part of application Ser. No. 13/481,708 filed in the United States Patent and Trademark Office on May 25, 2012 and which claims the benefit of provisional application No. 61/491,130 filed in the United States Patent and Trademark Office on May 27, 2011, the disclosures of which are incorporated herein by reference and priority to which are claimed.

BACKGROUND OF THE INVENTION

1. Field of the Invention

The present invention relates to modular building blocks and, in particular, to modular building blocks provided with interlocking reinforcement rods.

2. Description of the Related Art

It is known to provide modular building blocks with interlocking reinforcement rods. For example, U.S. Pat. No. 8,061,095 which issued on Nov. 22, 2011 to Bucheger discloses modular blocks provided with keys and keyways to allow for engagement of the blocks. The blocks are also provided with a vertical passageway through which reinforcement rods extend. Couplings are used to connect vertically aligned reinforcement rods. However, known modular building blocks with interlocking reinforcement rods are generally not provided with means to prevent rotation of the couplings. This may be problematic in cases where the couplings and reinforcement rods are threadedly connected. Rotation of couplings may result in the couplings and reinforcement rods coming unthreaded and the reinforcement capacity of the reinforcement rods being diminished.

SUMMARY OF THE INVENTION

It is an object of the present invention to provide an improved modular building block with a reinforcement rod.

It is also an object of the present invention to provide an improved locking assembly for connecting vertically aligned reinforcement rods of inter-engaged modular building blocks.

There is accordingly provided a modular building block assembly comprising a modular building block having a first load-bearing surface with a key. There is a recess in the key. The recess has a shoulder disposed therein and side walls extending from the shoulder to a mouth thereof. A reinforcement rod extends into the recess and a coupling for connecting vertically aligned reinforcement rods is disposed in the recess. The vertically aligned reinforcement rods each threadedly engage the coupling. A locking plate engages the coupling to prevent the coupling from rotating relative to the locking plate. The locking plate sits within the recess and rotation of the locking plate within the recess is prevented by the side walls of the recess.

The modular building block may have a second load-bearing surface with a keyway. The reinforcement rod may also extend into the keyway. There may be a hollow extending between the keyway and the recess in the key. The reinforcement rod may extend through the hollow. There may be a sleeve in the hollow. The reinforcement rod may extend through the sleeve in the hollow. There may be waterproof grease in the sleeve. There may be a frustoconical shaped recess disposed between the hollow and the keyway.

The locking plate may include a central opening for receiving the coupling. The coupling may have a polygonal cross-section and a threaded aperture extending longitudinally therethrough. The central opening in the locking plate may be a polygonal opening having the same number of sides as the coupling. For example, the coupling may have a hexagonal cross-section and the central opening in the locking plate may be a hexagon. There may be a peripheral opening in the locking plate.

There may be a lug extending from the first load-bearing surface of the modular building block. There may be a recess in the first load-bearing surface of the modular building block and a lug disposed in the recess.

There is also provided a structure constructed from the improved modular building block disclosed herein.

BRIEF DESCRIPTIONS OF DRAWINGS

The invention will be more readily understood from the following description of the embodiments thereof given, by way of example only, with reference to the accompanying drawings, in which.

DESCRIPTIONS OF THE PREFERRED EMBODIMENTS

Figure 1A:
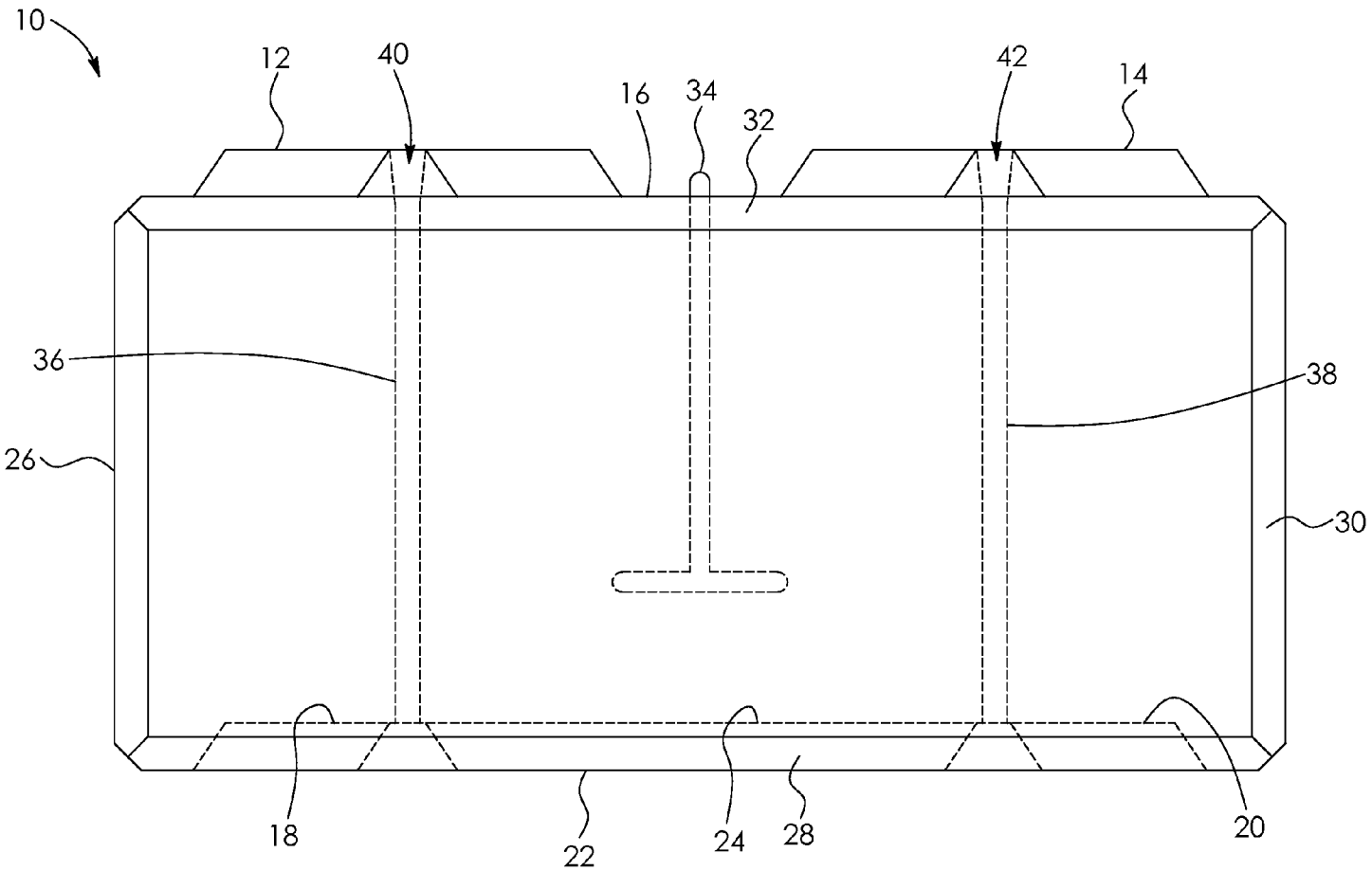
FIG. 1A is a side elevation view of a first embodiment of an improved modular building block.
Figure 2:
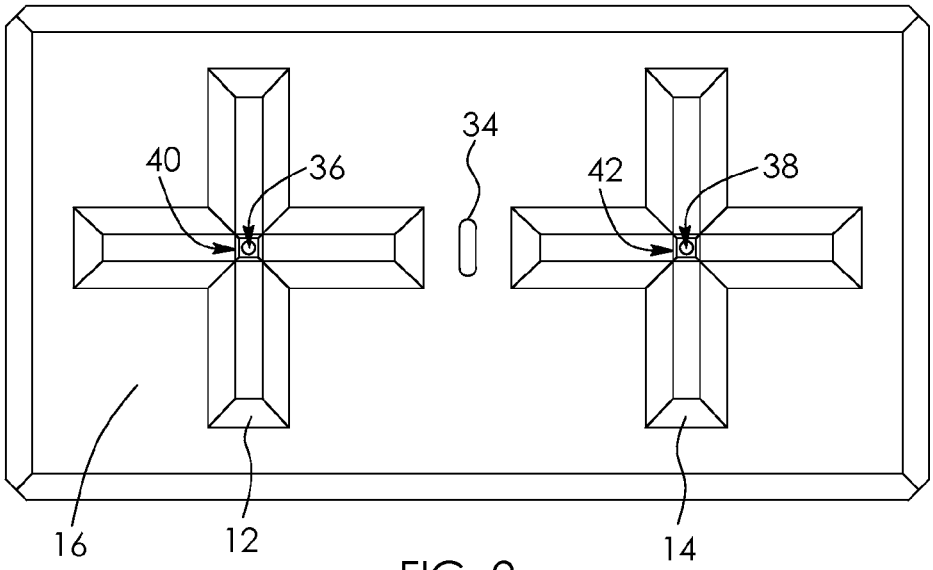
FIG. 2 is a top view of the modular building block of FIG. 1A.
Figure 3:
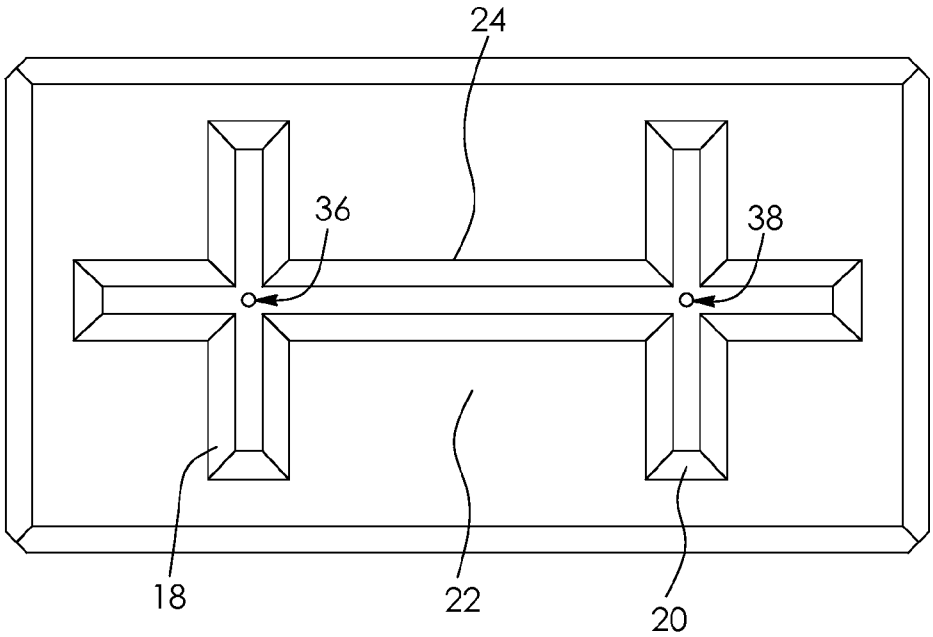
FIG. 3 is a bottom view of the modular building block of FIG. 1A.
Figure 4:
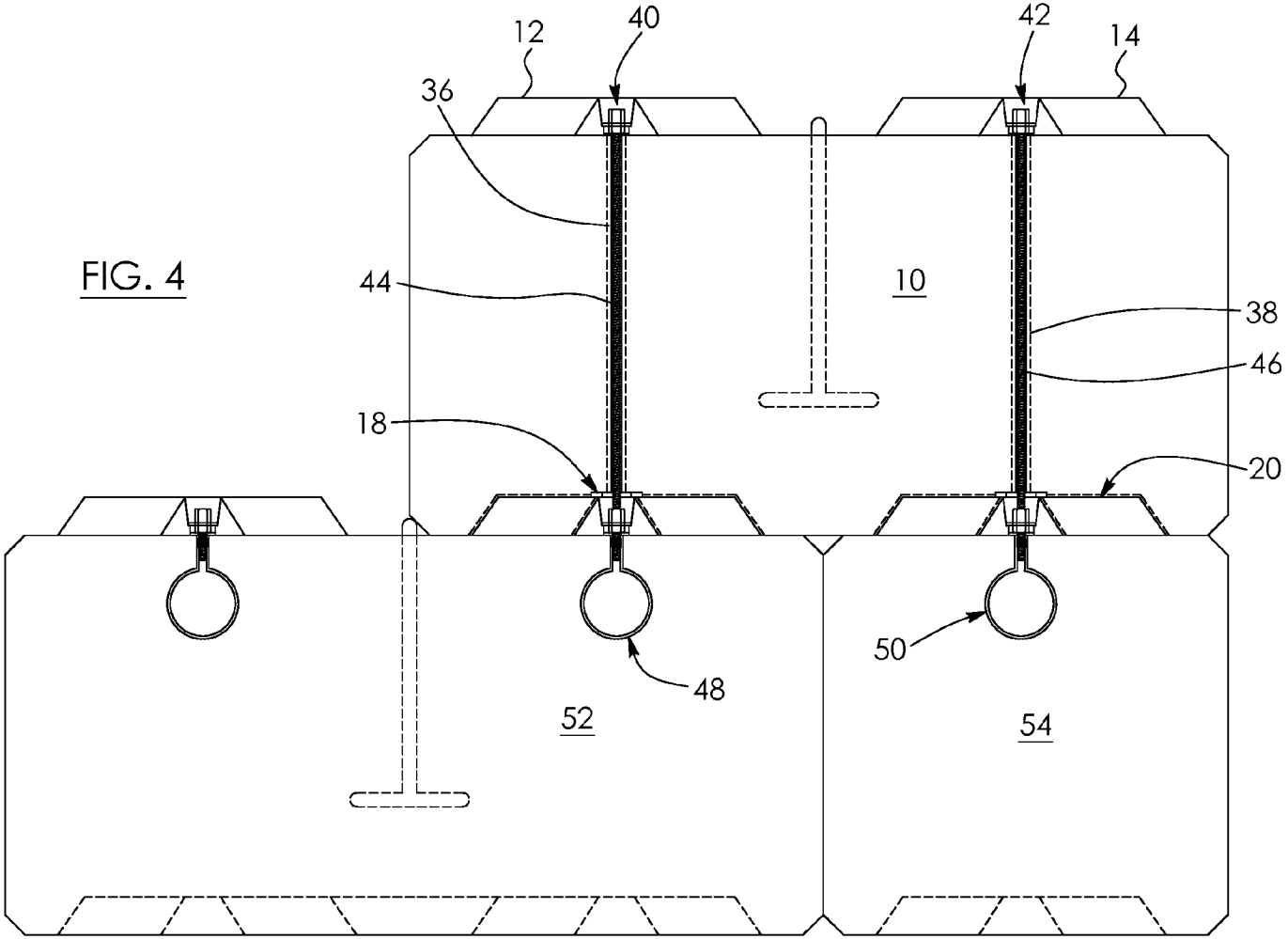
FIG. 4 is a sectional view showing the modular building block of FIG. 1A in a second course of a structure.
Figure 5:
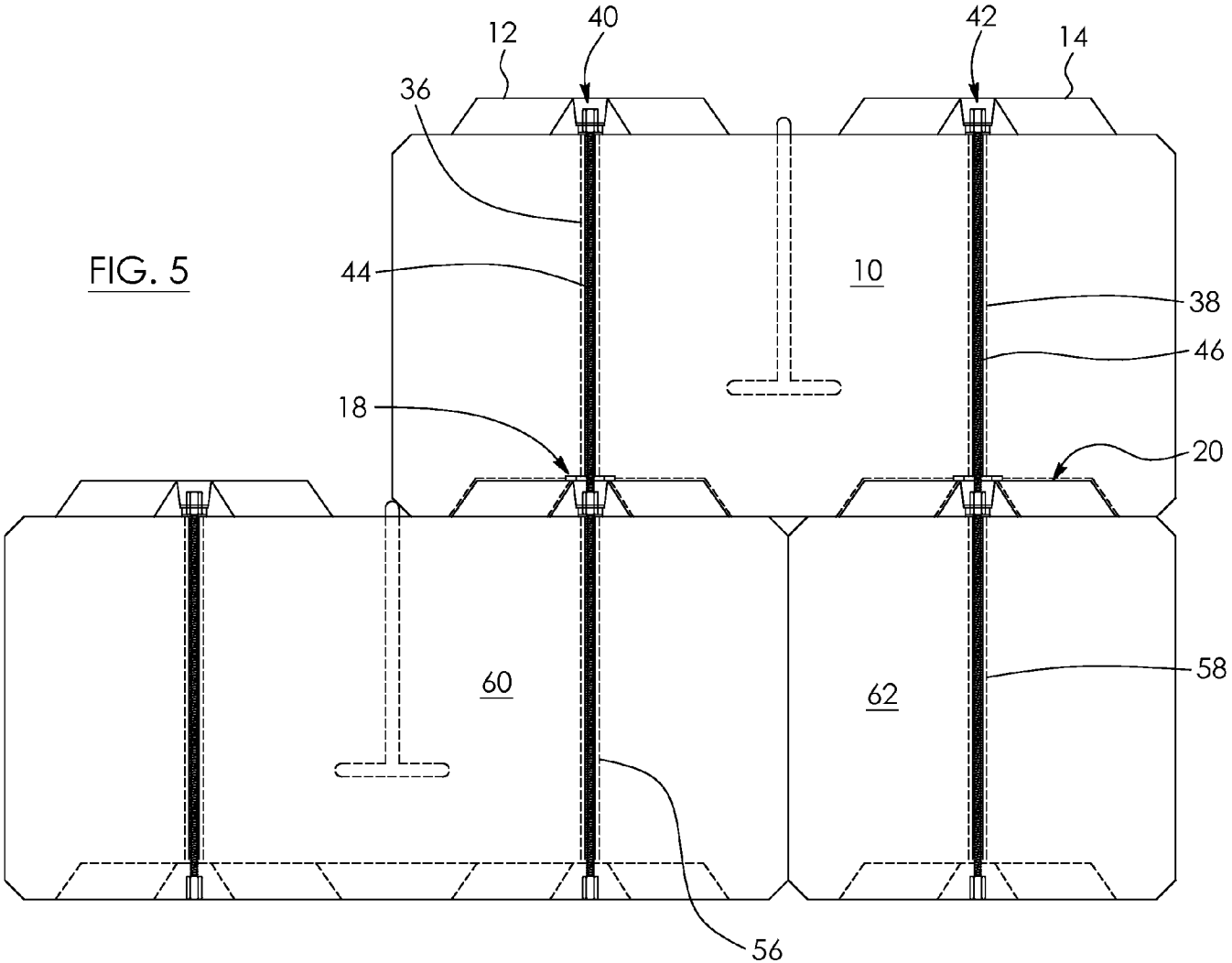
FIG. 5 is a sectional view showing the modular building block of FIG. 1A in a third course of a structure.

Referring to the drawings and first to FIG. 1A this shows a first embodiment of an improved modular building block 10. The building block 10 has a pair of protrusions or keys 12 and 14 on a first load-bearing surface 16 thereof and a pair of corresponding recesses or keyways 18 and 20 on a second load-bearing surface 22 thereof. The first load-bearing surface 16 is a top surface of the building block 10 and the second load-bearing surface 22 is a bottom surface of the building block 10. The keys and keyways are generally cross-shaped in this example as best shown in FIGS. 2 and 3. In this example, the keyways 18 and 20 also share a common leg 24 which extends between the keyways. The keys and keyways allow for inter-engagement of adjacent blocks as best shown in FIGS. 4 and 5.

Referring back to FIG. 1A, the building block 10 is also provided with chamfers, for example chamfers 26, 28, 30 and 32, at the corners between adjacent perpendicular surfaces thereof. The chamfers may function to lessen damage to the building block 10 if the building block is handled roughly. In other examples however the building block may not be chamfered to minimize openings between adjacent building blocks where debris may collect or animals may nest. There is a lug 34 embedded in the building block 10 and extending from the first load-bearing surface 16. The lug 34 may facilitate lifting and mooring of the building block 10 by means of cables or chains. The lug 34 is received by the common leg 24 of the keyways in an adjacent building block when the building blocks are stacked directly above each other. In examples where the building block is not chamfered it is desirable to provide nicks in the building block to accommodate the lugs of adjacent building blocks when the building blocks are stacked in a stretcher bond or situated at ninety degrees to adjacent building blocks. The building block, as thus far described, is accordingly conventional and similar to the type disclosed in U.S. Pat. No. 6,931,797 which issued to Drew on Aug. 23, 2005 and the full disclosure of which is incorporated herein by reference.

However, the building block 10 disclosed herein is further provided with passageways or hollows 36 and 38 extending between corresponding ones of the keys and keyways. More specifically the hollows 36 and 38 extend from respective recesses 40 and 42 in the keys 12 and 14 to the corresponding keyways 18 and 20. The hollows 36 and 38 are configured to receive respective reinforcement rods 44 and 46 as best shown in FIGS. 4 and 5. When the building block 10 is disposed on a second course of a structure, as shown in FIG. 4, the reinforcement rods 44 and 46 are coupled at the keyways 18 and 20 to respective anchors 48 and 50 which are embedded in foundation blocks 52 and 54 in a first course of the structure. When the building block 10 is disposed on a third or higher course of a structure, as shown in FIG. 5, the reinforcement rods 44 and 46 are vertically aligned and coupled at the keyways 18 and 20 to respective reinforcement rods 56 and 58 in blocks 60 and 62 on an immediately lower course of blocks.

Figure 1B:
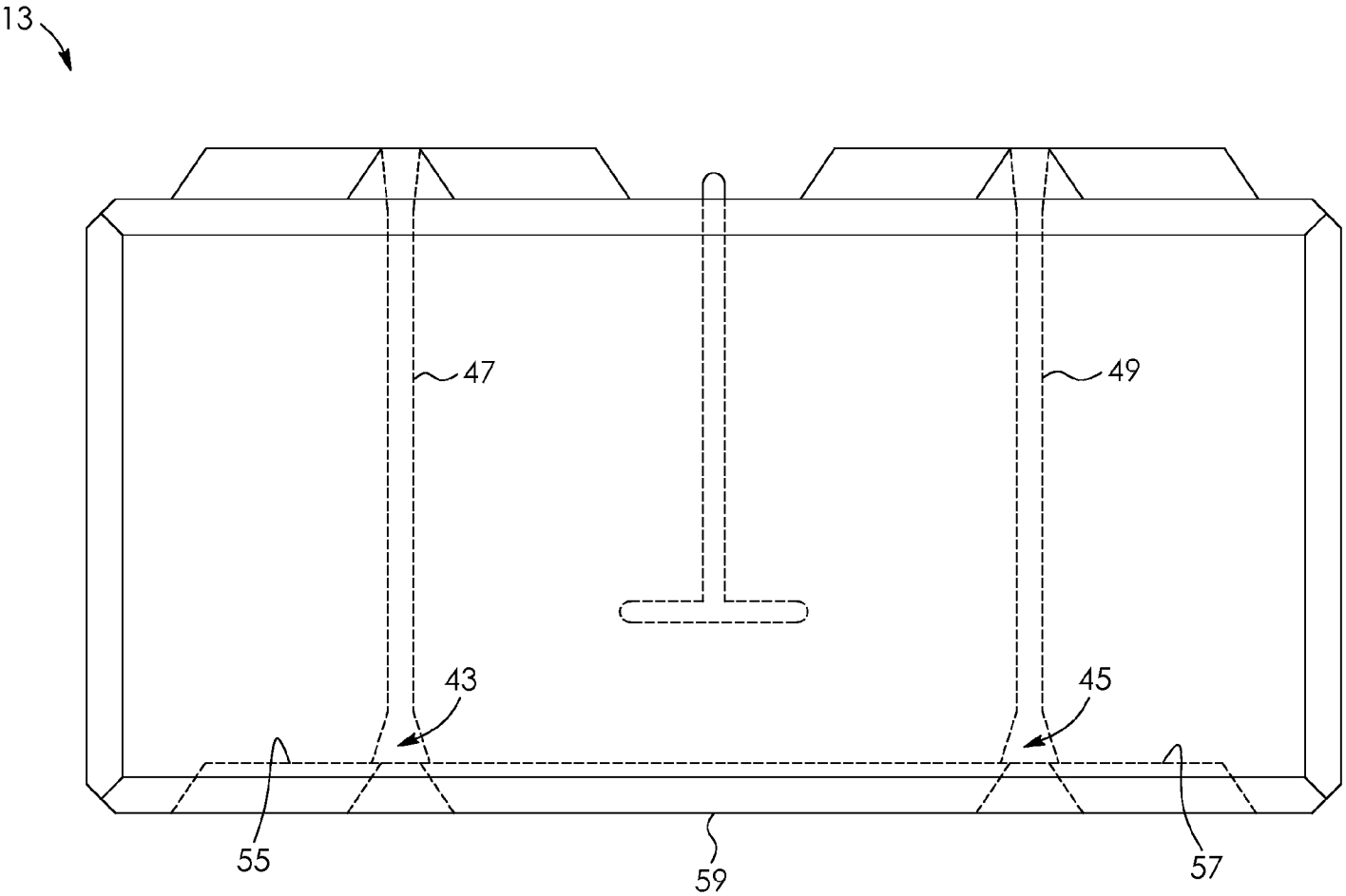
FIG. 1B is a side elevation view of a second embodiment of an improved modular building block.
Figure 1C:
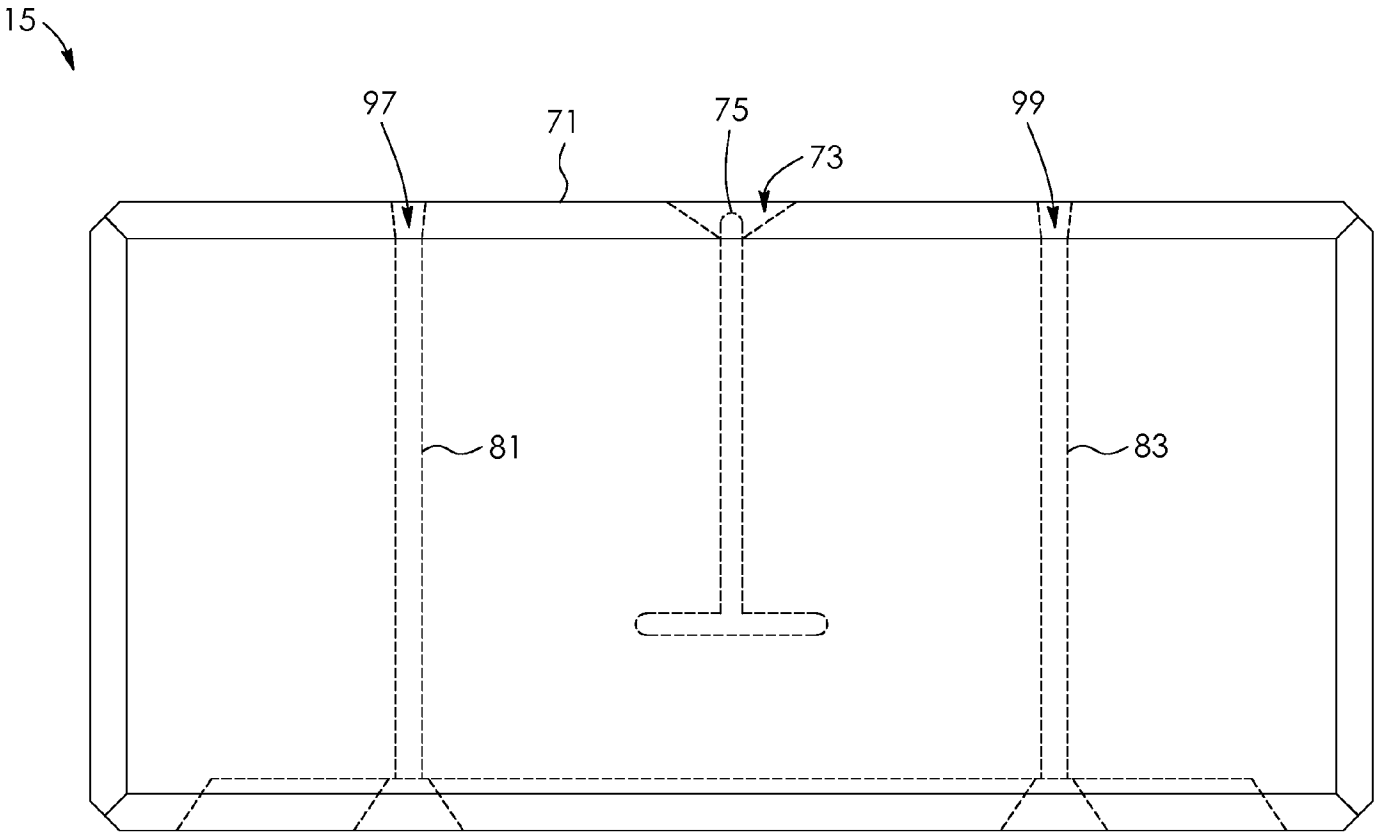
FIG. 1C is a side elevation view of a third embodiment of an improved modular building block.

FIG. 1B shows a second embodiment of an improved modular building block 13, which is substantially similar to the building block 10 shown in FIG. 1A, with the notable exception that there is a frustoconical shaped recess 43 and 45 disposed between each of the hollows 47 and 49 their corresponding keyway 55 and 57 near a bottom surface 59 of the building block 13. The frustoconical shaped recesses 43 and 45 facilitate alignment of the building block 13 with reinforcement rods threaded into a building block on a lower course when the building block 13 is lowered over said reinforcement rods. FIG. 1C shows a third embodiment of an improved modular building block 15, which is substantially similar to the building block 10 shown in FIG. 1A, with the notable exception that there are no keys in a top surface of 71 of the building block 15. The top surface 71 of the building block 15 is substantially planar and there is a recess 73 therein in which a lug 75 of the building block is disposed. The lug 75 accordingly does not extend beyond the top surface 71 of the building block 15. The building block 15 may accordingly be used as a top block. Hollows 81 and 83 of the building block 15 extend to corresponding recesses 97 and 99 which are similar to the recesses 40 and 42 in the building block of FIG. 1A. The recesses 97 and 99 of the building block 15 of FIG. 1C extend to the top surface 71 of the building block and allow for equipment to be anchored to couplings (not shown) threaded onto reinforcement rods (not shown) which extend into the hollows 81 and 83. The reinforcement rods however generally do not extend beyond the top surface 71 of the building block 15 and may only extend about halfway into the recesses 97 and 99 where they may threadedly connect to a coupling.

Figure 6A:
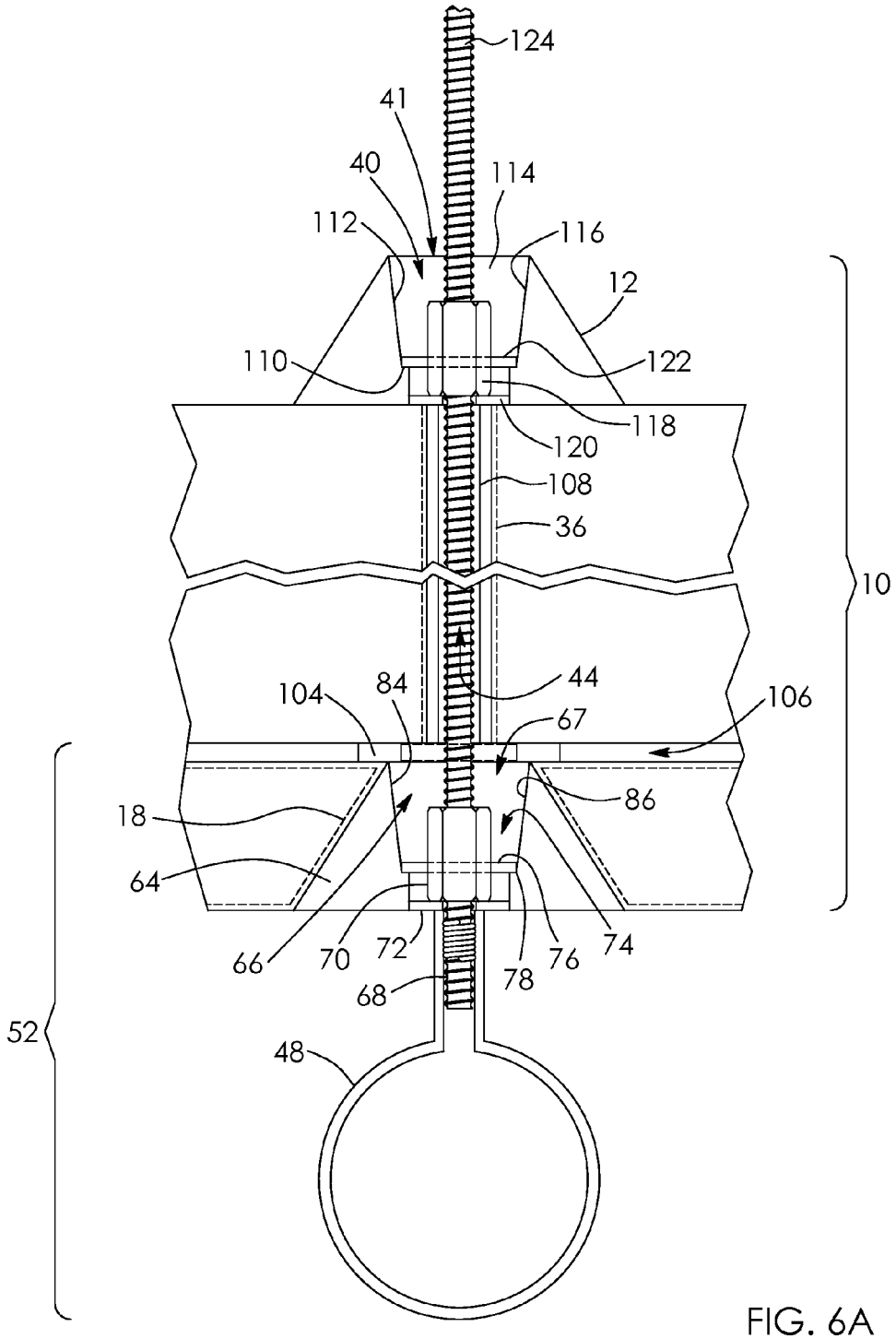
FIG. 6A is a fragmentary, sectional view showing the modular building block of FIG. 1A engaged and interlocked with a foundation block.
Figure 6B:
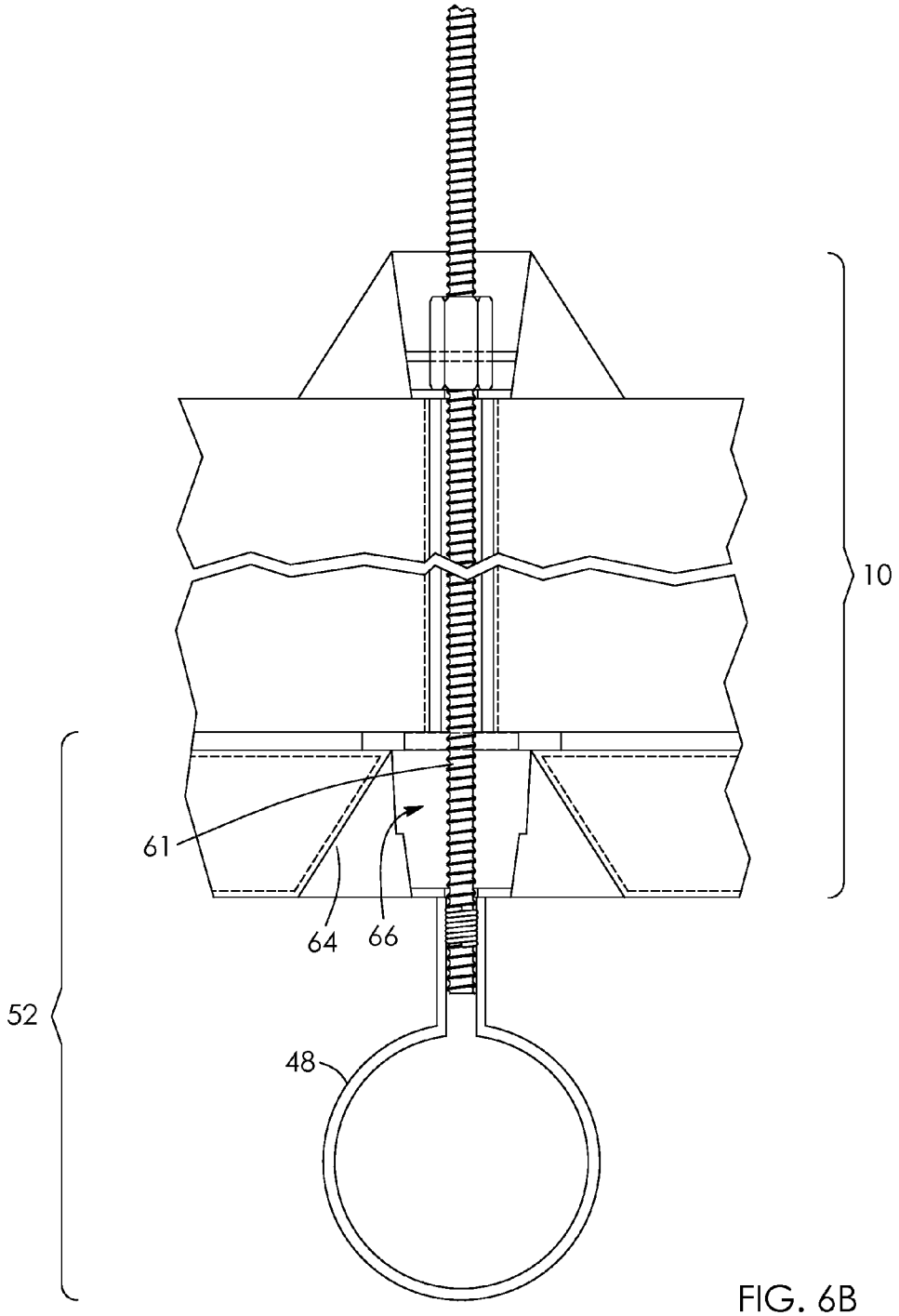
FIG. 6B is another fragmentary, sectional view showing the modular building block of FIG. 1A engaged and interlocked with a foundation block.
Figure 6C:
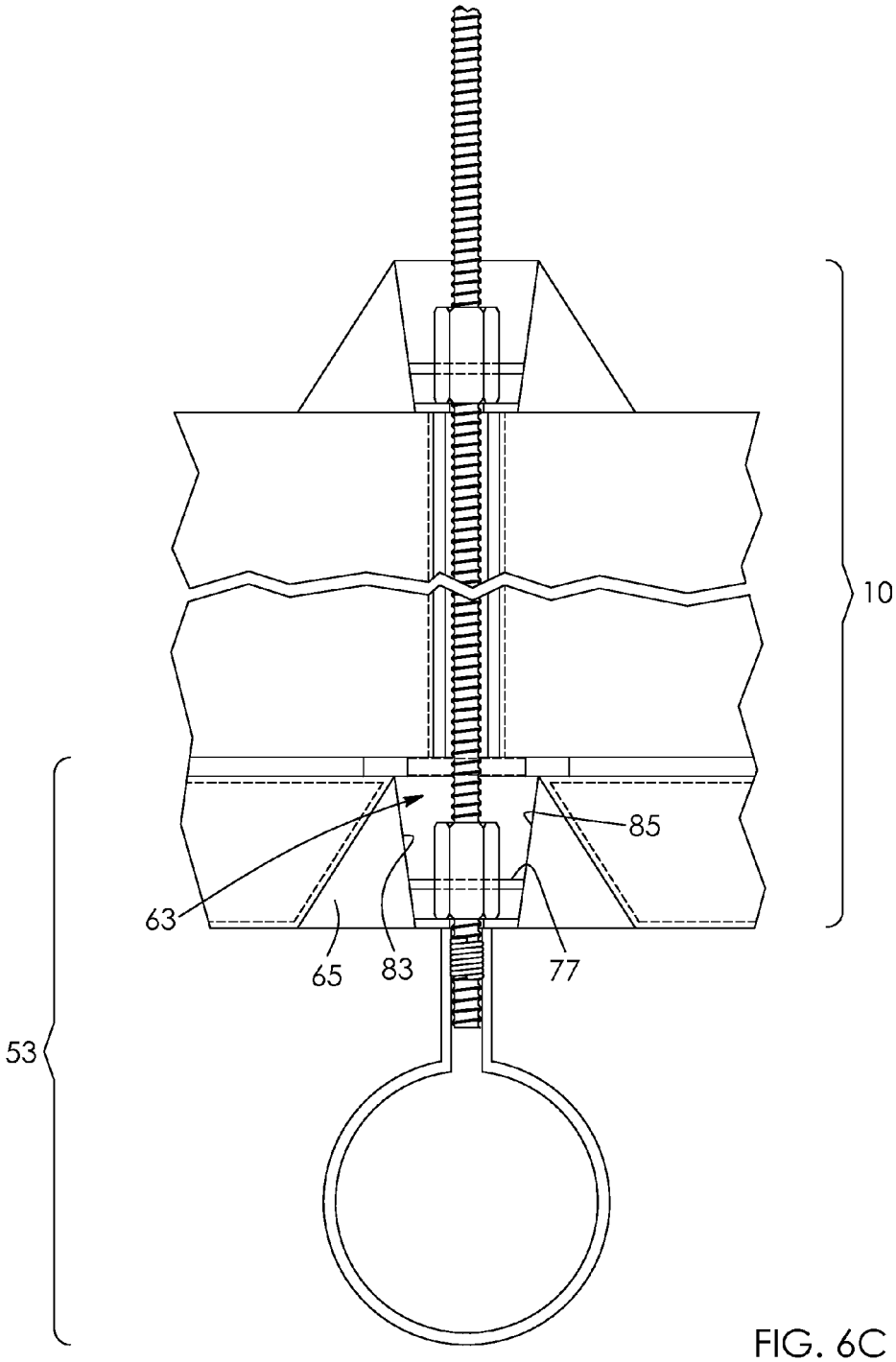
FIG. 6C is a fragmentary, sectional view showing another embodiment of a modular building block engaged and interlocked with a foundation block.
Figure 7:
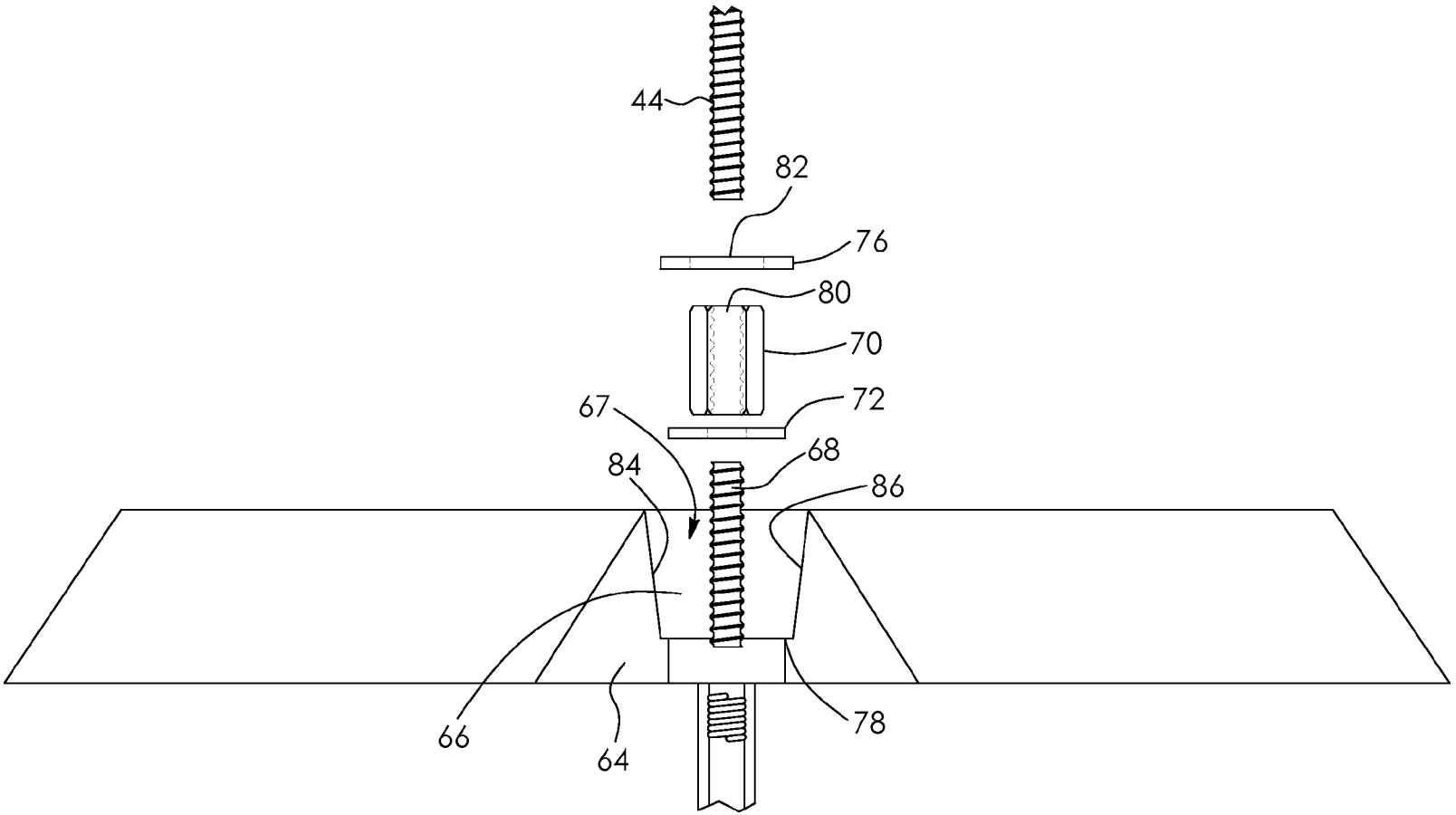
FIG. 7 is an exploded view showing a coupling and a locking mechanism of FIG. 6A.

Referring now to FIGS. 6A and 7, coupling of one of the reinforcement rods 44 and its corresponding anchor 48 is shown in greater detail with the understanding that the other one of the reinforcement rods is coupled to its corresponding anchor in a substantially similar manner using substantially similar components. A key 64 of the foundation block 52 engages the keyway 18 in the building block 10. There is a recess 66 in the key 64 of the foundation block 52 and the anchor 48 is embedded adjacent to the recess 66. In this example, the anchor 48 is a coil loop anchor which is in communication, via a threaded portion 68, with the recess 66 in the key 64 of the foundation block 52. The reinforcement rod 44 in the building block 10 and the threaded portion 68 of the anchor 48 threadedly engage an elongate nut which functions as a coupling 70 and are thereby coupled. There is a flange 72 which, in this example, is welded to the coupling 70 and functions as a washer for the coupling. There is also a locking mechanism 74 which includes a locking plate 76 and shoulder 78 disposed in the recess 66 in the key 64 of the foundation block 52. In this example, the shoulder 78 is the shape of a perimeter of a polygon. It is also possible for the building block 10 to be provided with a longer reinforcement rod 61 which directed engages the anchor 48 of foundation block 52 as shown in FIG. 6B. This does away with the need for a coupling and locking mechanism in the recess 66 in the key 64 of the foundation block 52. FIG. 6C shows another foundation block 53 which is substantially identical to the foundation block 52 of FIG. 6A with the exception that there is no shoulder disposed in a recess 63 in a key 65 of the foundation block 53. A foundation block with an anchor is however not strictly required. The building block 10 may function as a foundation block if couplings in the keyways thereof are tight against the block.

Figure 8:
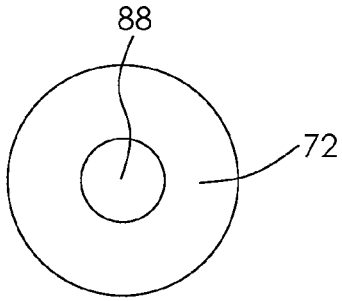
FIG. 8 is a plan view of a flange of the coupling of FIG. 7.
Figure 9:
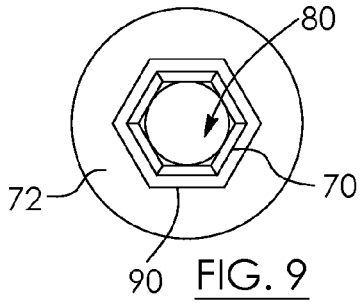
FIG. 9 is a plan view of the flange and the coupling of FIG. 7.
Figure 10:
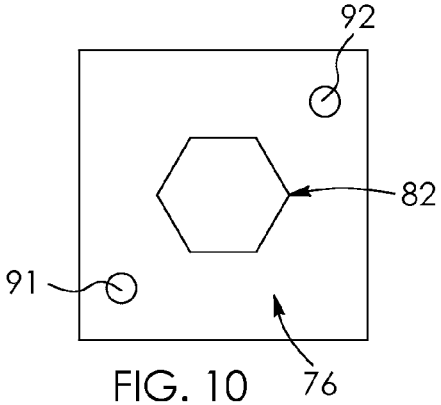
FIG. 10 is a plan view of a locking plate of the locking mechanism of FIG. 7.

Referring now to FIGS. 8 to 10, the coupling 70 has a polygonal cross-section, hexagonal in this example, and a threaded opening 80 extending longitudinally therethrough. The locking plate 76 is square in this example and has a central opening 82 that is configured to receive the coupling 70 and prevent rotation of the coupling relative to the locking plate, i.e. in this example the central opening in the locking plate is a hexagon. Referring back to FIG. 6A the locking plate 76 sits on the shoulder 78 in the recess 66 in the key 64 of the foundation block 52. The shoulder 78 has a square perimeter and side walls of the recess 66, for example walls 84 and 86, extend from the shoulder 78 to a mouth 67 of the recess. Rotation of the locking plate 76 is accordingly prevented when the locking plate 76 is seated on the shoulder 78. Rotation of the coupling within the recess 66 is also prevented since the coupling 70 is not able to rotate relative to the locking plate 76. Preventing rotation of the coupling 70 is desirable because rotation may cause the coupling 70 and the reinforcement rod 44 to unthread, thereby diminishing reinforcement capacity of the reinforcement rod. In the embodiment of FIG. 6C a locking plate 77 fits within the recess 63 and tapered walls, for example tapered walls 83 and 85 of the recess 63. The tapered walls 83 and 85 of the recess allow for easy stripping of the mold of the building block. The tapered walls also allow for a tight fit of the locking plate when there are small variations in the size of the recess or dimensions of the locking plate.

Figure 11:
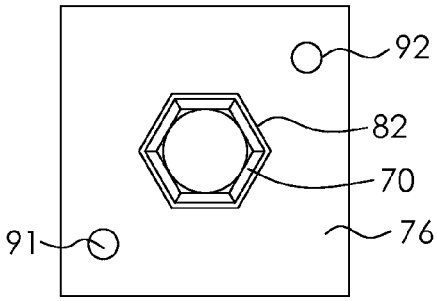
FIG. 11 is a plan view of the coupling and the locking plate of FIG. 7.
Figure 12:
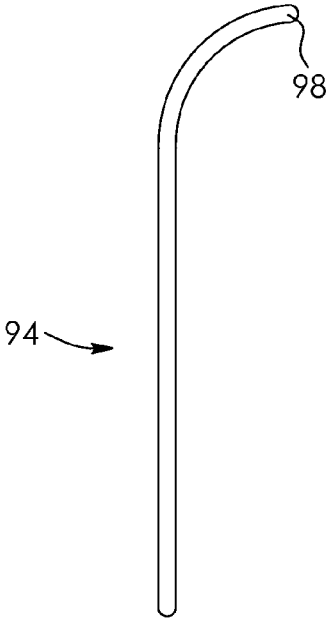
FIG. 12 is an elevation view of a tool used to set or remove the locking plate of FIG. 7.
Figure 13:
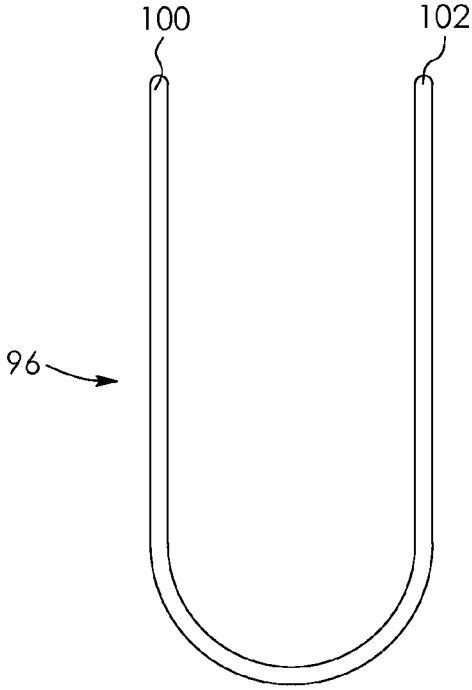
FIG. 13 is an elevation view of a tool used to set or remove the locking plate of FIG. 7.

The flange 72 is best shown in FIG. 8 and includes a central opening 88 to allow the threaded portion 68 of the anchor 48 to pass through the flange 72 and into the coupling 70 as shown in FIG. 6A. In this example the flange 72 is welded to the coupling 70 by welds 90 as best shown in FIG. 9. The locking plate 76 and central opening 82 thereof are best shown in FIG. 10. The coupling 70 is received by the central opening of the locking plate 76 as best shown in FIG. 11. The locking plate 76 also includes peripheral openings 91 and 92 which are used to set or remove the locking plate during construction of a structure. A hooked removal tool 94, shown in FIG. 12, or a U-shaped removal tool 96, shown in FIG. 13, may be used to engage the peripheral openings 91 and 92 and move the locking plate during setting or removal of the locking plate 76. A hooked end 98 of the hooked removal tool 94 may be used to engage either of the peripheral openings 91 and 92 of the locking plate 76 to guide movement of the locking plate 76 in the recess of the key. It is also possible to use two hook removal tools with each hook removal tool engaging a corresponding peripheral opening in the locking plate. This prevents twisting and bending of the locking plate during removal. Alternatively, remote ends 100 and 102 of the U-shaped tool 96 may be used to engage respective ones of the peripheral openings 91 and 92 of the locking plate 76 to guide movement of the locking plate 76 in the recess of the key.

Referring back to FIG. 6A, in this example, there is also an annular gasket 104 between the foundation block 52 and the building block 10. The gasket 104 seals the recess 66 in the key 64 of the foundation block 52 as well as a drainage gap 106 between successive courses of building blocks. This facilitates the filling of the recesses, for example recesses 40 and 66, with waterproof grease, grout or other material. The reinforcement rod 44 extends from the coupling 70 in the recess 66 in the key 64 of the foundation block 52, through the hollow 36 in the building block 10, to the recess 40 in the key 12 of the building block. There may be a cylindrical sleeve 108 in the hollow 36 to partially encase the reinforcement rod 44. The sleeve 108 may be filled with waterproof grease, grout or other material to minimize corrosion of the reinforcement rod 44.

Figure 14:
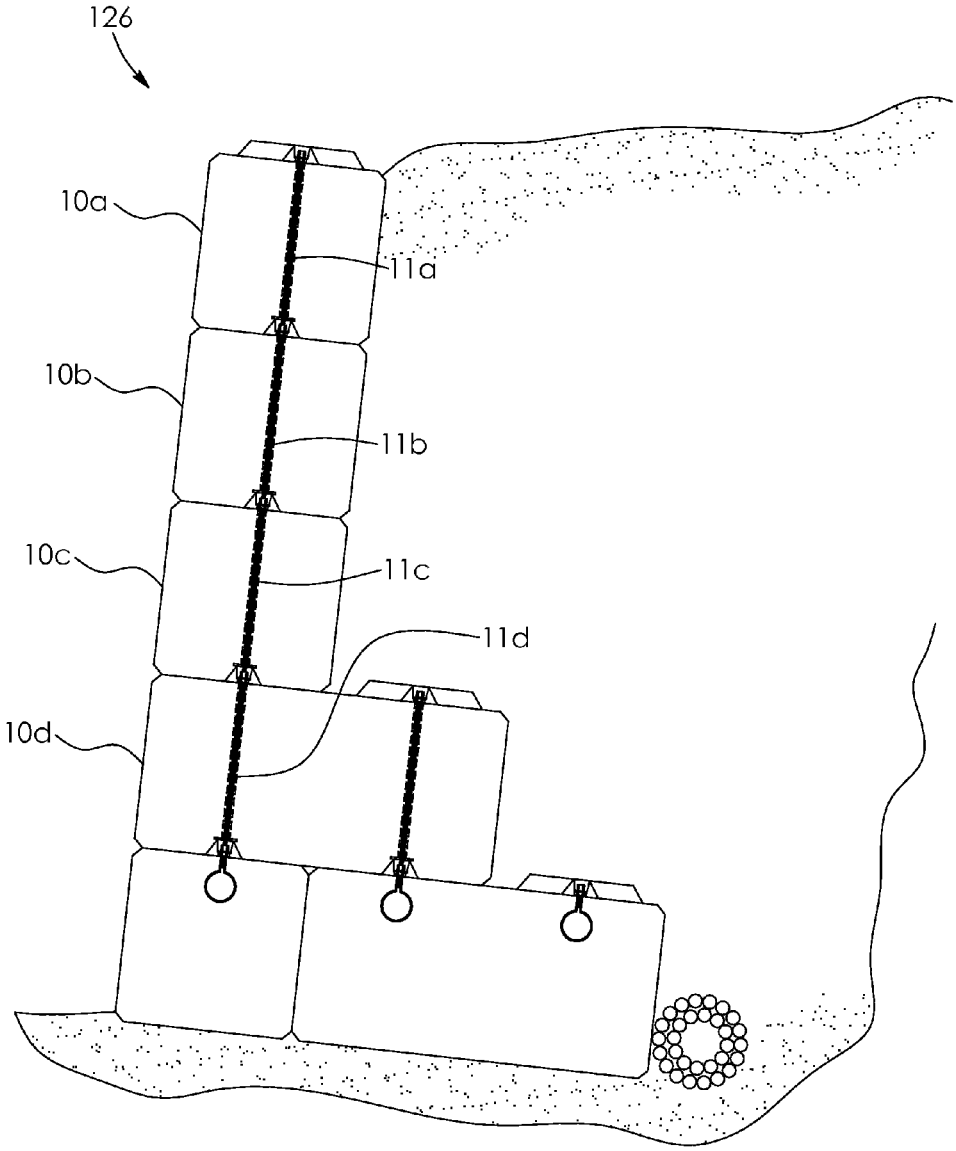
FIG. 14 is a sectional view of a retaining wall constructed using the modular building block of FIG. 1A.

The configuration of the recess 40 in the key 12 of the building block 10 is substantially identical to the configuration of the recess 66 in the key 64 of the foundation block 52. There is shoulder 110 with a square perimeter disposed in the recess 40 and side walls of the recess, for example side walls 112, 114 and 116, extend from the shoulder to a mouth 41 of the recess. The reinforcement rod 44 is able to threadedly engage a coupling 118 in the recess 40. The coupling 118 is substantially identical to the above described coupling 70 and is also provided with a flange 120 which functions as a washer. A locking plate 122 which is substantially identical to the above described locking plate 76 may be used to prevent rotation of the coupling 118 in the recess 40. A reinforcement rod 124 of another building block (not shown) may then threadedly engage the coupling 118 to couple the reinforcement rods 44 and 124 together during the construction of a structure, for example a retaining wall 126 as shown in FIG. 14, in which a plurality of building blocks 10*a*, 10*b*, 10*c* and 10*b* are inter-engaged at their keys and keyways as well as interlocked at points of connection of their reinforcement rods 11*a*, 11*b*, 11*c* and 11*d* as described above. Preventing rotation of the couplings which interlock the reinforcement rods prevents the reinforcement rods and couplings from unthreading during the removal of damaged building blocks from the wall. This is also advantageous because unthreading of the reinforcement rods from the couplings may diminish the reinforcement capacity of the reinforcement rods and cause premature collapse. Preventing rotation of the couplings which interlock the reinforcement rods further allows for easy disassembly of the wall without damaging the components thereof. This allows for future use of the components in a new location if desired.

It will be understood by a person skilled in the art that many of the details provided above are by way of example only, and are not intended to limit the scope of the invention which is to be determined with reference to the following claims.

What is claimed is:

1. A modular building block assembly comprising:

a modular building block having a first load-bearing surface with a key and a recess in the key, the recess having side walls extending to a mouth of the recess;

a reinforcement rod extending into the recess and a coupling disposed within the recess for connecting vertically aligned reinforcement rods, said vertically aligned reinforcement rods threadedly engaging the coupling; and a locking plate engaging the coupling to prevent the coupling from rotating relative to the locking plate, wherein the locking plate sits within the recess and rotation of the locking plate within the recess is prevented by the side walls of the recess.

2. The modular building block assembly as claimed in claim 1 wherein the block has a second load-bearing surface with a keyway, and the reinforcement rod also extends into the keyway.

3. The modular building block assembly as claimed in claim 2 wherein the block has a hollow extending between the keyway and the recess in the key, and the reinforcement rod extends through the hollow.

4. The modular building block assembly as claimed in claim 3 further including a sleeve in the hollow, wherein the reinforcement rod extends through the sleeve in the hollow.

5. The modular building block assembly as claimed in claim 4 further including waterproof grease in the sleeve.

6. The modular building block assembly as claimed in claim 3 further including a frustoconical shaped recess disposed between the hollow and the keyway.

7. The modular building block assembly as claimed in claim 1 wherein the locking plate includes a central opening for receiving the coupling.

8. The modular building block assembly as claimed in claim 7 wherein the coupling has a polygonal cross-section with a threaded aperture extending longitudinally therethrough and the central opening in the locking plate is a polygonal opening having the same number of sides as the coupling.

9. The modular building block assembly as claimed in claim 8 wherein the coupling has a hexagonal cross-section and the central opening in the locking plate is a hexagon.

10. The modular building block assembly as claimed in claim 7 wherein the coupling has a polygonal cross-section with a threaded aperture extending longitudinally therethrough and the central opening in the locking plate is a polygonal opening having the same number of sides as the coupling or multiples thereof.

11. The modular building block assembly as claimed in claim 7 further including a peripheral opening in the locking plate.

12. The modular building block assembly as claimed in claim 1 wherein the recess of the key of the block is a perimeter of a polygon.

13. The modular building block as claimed in claim 12 wherein the locking plate is a polygon having the same number of sides as the side walls of the recess.

14. The modular building block assembly as claimed in claim 12 wherein the recess is square and the locking plate is square.

15. The modular building block assembly as claimed in claim 1 further including a lug extending from the first load-bearing surface of the modular building block.

16. The modular building block assembly as claimed in claim 1 further including a recess in the first load-bearing surface of the modular building block and a lug disposed in the recess.

17. A structure comprising the modular building block assembly of claim 1.

* * * * *